United States Patent [19]

Thaler et al.

[11] Patent Number: 4,581,519

[45] **Date of Patent: * Apr. 8, 1986**

[54] FLOCKED CURLING IRON

[75] Inventors: Arnold Thaler, Plantation; David Friedson, Miami, both of Fla.; Lai Kin, Kowloon, Hong Kong

[73] Assignee: Windmere Corporation, Hialeah, Fla.

[ * ] Notice: The portion of the term of this patent subsequent to Oct. 16, 2001 has been disclaimed.

[21] Appl. No.: 640,590

[22] Filed: Aug. 14, 1984

Related U.S. Application Data

[63] Continuation of Ser. No. 397,169, Jul. 12, 1982, Pat. No. 4,477,716.

[51] Int. Cl.[4] ..... H05B 1/00; A45D 1/02

[52] U.S. Cl. ..... 219/225; 219/230; 132/32 R; 132/37 R; 132/34 R

[58] Field of Search ..... 219/225, 222, 230; 132/32 R, 37 R, 33 R, 39, 40; 38/69, 93; 68/223; 428/90, 95

[56] References Cited

U.S. PATENT DOCUMENTS

| | | | |
|---|---|---|---|
| Re. 30,618 | 5/1981 | Van Dyck et al. | 219/225 |
| 1,284,792 | 11/1918 | Schwartz | 219/225 |
| 3,488,471 | 1/1970 | Gstalder | 132/33 R |
| 3,491,774 | 1/1970 | Carbone | 132/33 R X |
| 3,566,886 | 3/1971 | Solomon | 132/39 |
| 3,888,266 | 6/1975 | Weldon et al. | 132/39 |
| 3,937,230 | 2/1976 | Kenny | 132/37 R |
| 4,163,143 | 7/1979 | Federico et al. | 219/225 |
| 4,202,360 | 5/1980 | Henry | 132/40 |
| 4,233,999 | 11/1980 | Thomas | 219/225 X |
| 4,267,431 | 5/1981 | Rick et al. | 132/37 R |
| 4,267,851 | 5/1981 | Plaisted | 132/33 R |
| 4,329,567 | 5/1982 | Kunz et al. | 219/222 |
| 4,365,140 | 12/1982 | Bast et al. | 219/225 |
| 4,368,376 | 1/1983 | Andis | 219/222 |
| 4,477,716 | 10/1984 | Thaler et al. | 219/225 |

FOREIGN PATENT DOCUMENTS

| | | |
|---|---|---|
| 98026 | 2/1964 | Denmark . |
| 1237979 | 4/1967 | Fed. Rep. of Germany . |
| 2013851 | 10/1971 | Fed. Rep. of Germany . |
| 1258562 | 5/1963 | France . |
| 1377552 | 2/1965 | France . |

*Primary Examiner*—C. L. Albritton
*Assistant Examiner*—M. M. Lateef
*Attorney, Agent, or Firm*—Odin, Feldman & Pittleman

[57] ABSTRACT

An improved hair curling iron is disclosed having a heat conductive cylinder with a flocked outer surface and a hollow center, a handle joined to the cylinder, a heating element disposed within the hollow center of the cylinder, an electrical mechanism activating the heating element when connected to a source of electrical power, and a clamp having a partial cylindrical section with a flocked inner surface which is biased against the flocked outer surface of the cylinder by a spring.

26 Claims, 3 Drawing Figures

FLOCKED CURLING IRON

This is a continuation of application Ser. No. 379,169 filed July 12, 1982, now U.S. Pat. No. 4,477,716.

BACKGROUND OF THE INVENTION

The invention relates to hair curling irons.

Curling irons have been known for many years. They have been configured in various designs which have used electrical heating elements to heat a cylindrical surface around which hair is wrapped to apply a heat set wave to the hair. These curling irons also have a spring biased clamp, having a partial cylindrical section which engages the cylinder around which the hair is wrapped. The clamp facilitates curling of the hair by holding the hair firmly against the cylinder. The clamp is typically biased against the cylinder and arranged to be pivoted away from the cylinder by movement of handle by the user. When the handle on the clamp is released the clamp engages the cylinder.

In the prior art curling irons, both the cylinder around which the hair is wrapped to produce curl and the clamp have been made from hard smooth substances, which have good heat conducting properties, such as metal. The use of hard smooth substances to make the cylindrical curling iron and the clamp, however, has a tendency to damage the hair because the surface is noncompliant which can cause strain and/or breakage of the hair. Moreover, the smooth surfaces of the cylinders and clamps of the prior art curling irons do not promote secure gripping of the hair between the cylinder and the clamp which has the tendency to permit the hair to slide off of the cylinder if the user's hair is long. These prior art curling irons also have the disadvantage of causing ridging of the hair. The ridging problem arises as a result of the hair being held in contact with a hot smooth cylinder for too long a period of time.

Several attempts have been made to avoid somewhat related problems that occur in the use of heated curling rollers by covering the rollers with a flocking material. The problems involved from the use of the curling irons are more severe due to the grasping of the hair between the clamp and the cylinder. The problems with the curling irons, however, remained unsolved.

Flocked curling rollers are disclosed in U.S. Pat. Nos. 4,202,360 to Walter and 3,888,266 to Weldon and in French Pat. Nos. 1,254,526 and 1,377,552.

SUMMARY OF THE INVENTION

An object of the present invention is to provide an improved hair curling iron.

Another object of the present invention is to provide a hair curling iron that more firmly grasps the hair for curling without causing damage to the hair so as occurs with prior hair curling irons.

A further object of the present invention is to provide a hair curling iron that serves to avoid the problem of ridging as commonly occurs with prior curling irons.

The invention has advantages over the prior art curling irons. The application of flocking to the outer surface of the curling cylinder and to at least the inner surface of the partial cylindrical section of the clamp as well as preferably the top of the clamp both reduces damage to hair and significantly improves the manageability of the hair by the user. The reduction in damage to the hair arises for the reason that the flocking is soft, and, therefore, nondamaging to hair and also tends to not burn the hair such as a hot smooth cylindrical surface would do. Further, the large amount of surface area provided by the flocking tends to eliminate ridging effects when curling the hair. Finally, the large surface area provided by the flocking on the curling cylinder and the inner surface of the partial cylindrical section produces a firm grip between the curling iron surface and the clamp which resists the tendency of the hair to slide off the cylinder, especially in the case where the user has long hair requiring multiple turns around the curling cylinder.

A curling iron in accordance with the invention includes a heat conductive cylinder having a flocked exterior surface and a hollow center, a handle joined to the cylinder, a heat conducting element located within the hollow center of the cylinder for radiating heat to the body of the cylinder, an electrical mechanism for electrically activating the heating element when connected to a source of electrical power and a clamp having a partial cylindrical section with at least a flocked inner surface which is biased against the flocked outer surface of the cylinder to firmly grip hair wrapped in contact with the flocked outer surface of the cylinder. The cylinder may be made from a heat conductive plastic or a metallic substance such as aluminum. The clamp may further include a projection which extends from the cylinder toward the handle for the purpose of permitting the selective pivoting of the partial cylindrical section away from engagement of the outer flocked surface of the cylinder to permit the user to grasp the hair between the cylinder and the clamp for wrapping the hair around the curling iron.

DESCRIPTION OF THE PREFERRED EMBODIMENTS

Figure 1:
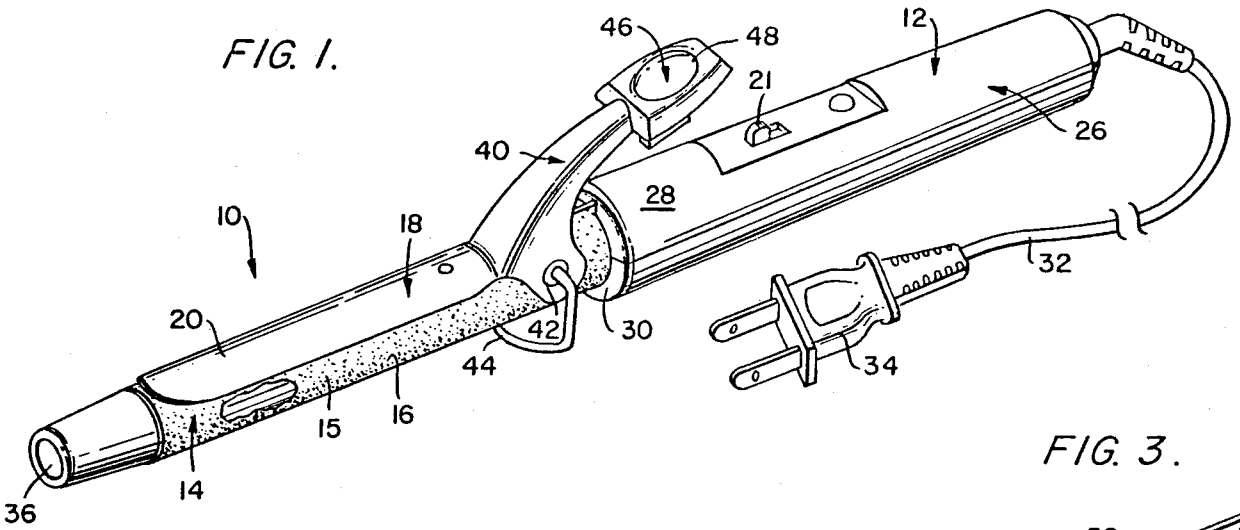
FIG. 1 is a perspective view of the invention.

A curling iron in accordance with the invention is illustrated in perspective in FIG. 1. The curling iron 10 has three main parts, which are: a handle 12, a curling cylinder 14 which is joined to the handle having a flocked exterior surface 16; and a clamp 18 which has a partial cylindrical section 20 biased into contact with the outer surface of the cylinder. The outer surface of curling cylinder 14 and both the inner and outer surfaces of clamp 18 are covered with a flocking material.

Figure 3:
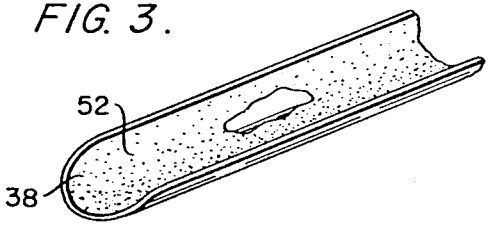
FIG. 3 is a view illustrating the flocked inner surface of the clamp.

Handle 12 of curling iron 10 can include a switch 21 which has at least two settings and permits the selective application of electrical power to a heating element 22 located within the hollow center 24 of the cylinder 14, as shown in FIG. 3. Instead of switch 21, it is possible to use a variable rheostat so that there is greater control over the heat applied or to eliminate this switch and merely have the unit switch on and off by plugging the electrical cord into an electrical outlet. The handle 12 has a body 26 which has two halves 28 and 30 which are preferrably made from plastic or any other material which may be readily molded at a relatively low cost. A cord 32 is attached to the end of the body 26 and for the purpose of connecting the curling iron 10 to a source of electrical power when plug 34 is placed within a socket of an electrical outlet. The curling cylinder 14 may be made from a heat conductive plastic material or a metal such as aluminum. The cylinder 14 has a tip 36 which is made from a non-heat conductive material such as plastic and is attached to the cylinder by a screw of other suitable connecting means (not illustrated).

The layer of flocking which is attached to the outside surface 16 of the cylinder 12 may be formed by any nonhydroscopic material such as nylon. The density of the fibers of the flocking, and their length and denier are not critical and may be varied. Prior to applying flocking material, the surface of the cylinder 14 is preferrably roughened to promote the adhesion of flocking to it. When a metal such as aluminum is used to fabricate the cylinder 14, sandblasting may be used to roughen the exterior surface 16 to prepare it for flocking.

Many methods are known for applying flocking 15 to cylindrical surfaces. However, one method of applying the flocking 15 which may be used with the invention is to create a slurry of the fiber and a curable adhesive substance which upon the application of an electrostatic field to the cylinder will cause the fibers to stand up. The fibers are fixedly attached to the outer surface 16 of the cylinder 14 and their standing orientation after a suitable curing period. The invention is not limited to any particular method of applying the flocking.

Clamp 18 includes a partial cylindrical section 20 having a flocked interior surface 38 and preferably a flocked outer surface 20. The flocking on the clamp, such as flocking 52 on the interior surface 38, is normally identical to that applied to the outer surface 16 of the cylinder 14.

Clamp 18 also includes a projection 40 which extends from the partial cylindrical section toward the handle 12. The projection 40 has two extensions 42 which are pivotally attached to the cylinder 14 at diametrically opposite points within the cylinder wall. A wire member 44 connects the pivot points together and may be positioned as shown in FIG. 1 to facilitate the hanging of the curling iron. The projection 40 terminates in a molded piece 46 which has a depression 48 adapted to receive the thumb of the user.

Figure 2:
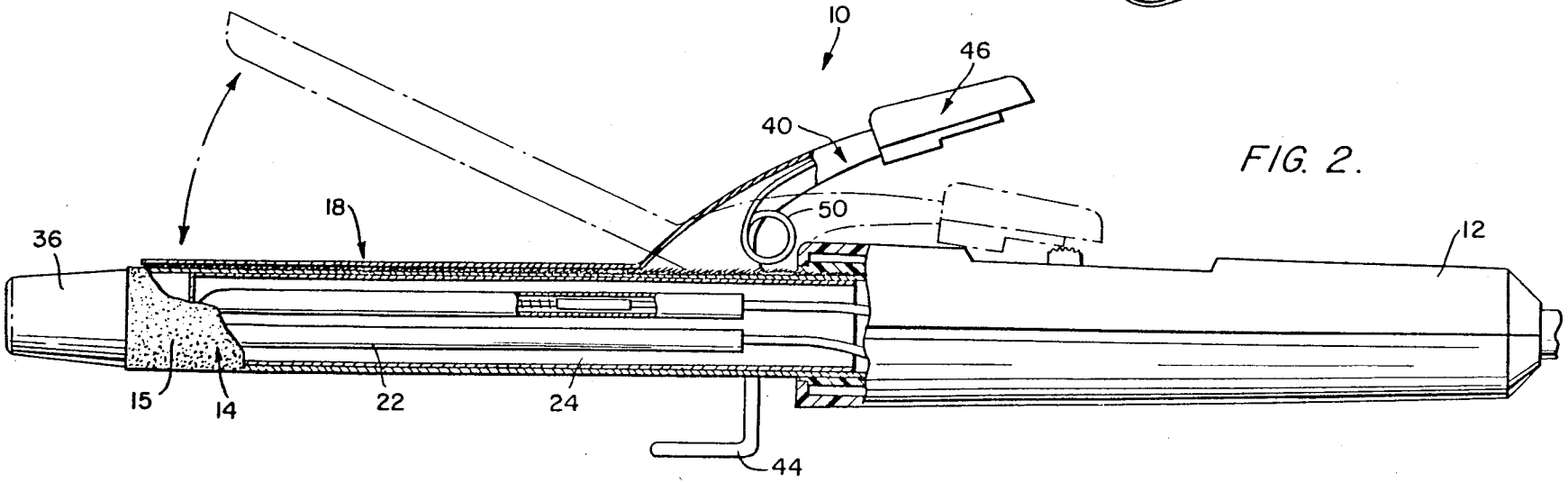
FIG. 2 is a partial sectional view of the curling cylinder which illustrates its interior.

FIG. 2 illustrates a partial sectional view of the curling iron of FIG. 1. In FIG. 2, the two extreme positions of the clamp 18 are illustrated. The position shown in phantom is that which the user uses to slip the curling iron onto the hair for grasping the hair between cylinder 14 and interior surface 38 of the clamp 18. The user then wraps hair around the flocked outer surface 16 of the curling cylinder 14 and flocked outer surface 20 of clamp 18 in preparation for heat activated curling of the hair.

The second position of the clamp 18, which is illustrated in non-phantom, is that which the clamp 18 assumes during the use of the curling iron 10 to curl hair and during its storage.

The non-phantom position of the clamp 18, as shown in FIGS. 1 and 2, is maintained by a spring 50 having two ends and which are respectively captured by the upper half 28 of the handle 12 and the end of the projection 40 in proximity to the molded piece 46 so that the spring is in a compressed state when the clamp 18 is in the non-phantom position. The spring 50 performs the function of biasing the clamp into the non-phantom position so that during use the hair will be firmly held in surface contact with the flocking of the inner surface 38 of the clamp 18 (FIG. 3) and the outer surface 16 of the cylinder 14. The hollow center 24 of the cylinder 14 contains the heating element 22. The specific design of the heating element is a matter of choice which does not constitute part of the invention.

FIG. 3 illustrates the inner flocked surface 38 of the clamp 18. The flocking 52 is adhesively secured to the inner surface 56 of the partial cylindrical section 20 of the clamp 18 by an application process and a mechanism identical to that used to secure the flocking 15 to the outer surface 16 of cylinder 14. The clamp 18 is preferably made from a metal such as aluminum but it should be understood that other materials, such as plastic, may also be used.

The use of flocking 15 on the outer surface 16 of the cylinder 14 and flocking 52 on the inner surface 38 of the clamp 18 produces several advantages which are not realized in the prior art. The use of flocking on both surfaces permits firm frictional engagement of the hair between the curling cylinder 14 of the curling iron 10 and the partial cylindrical section 20 of the clamp 18. The firm grip of the hair between the curling iron and the clamp is highly desirable in that it prevents the hair from becoming unravelled from the curling iron during use. The flocking also tends to minimize the burning of the hair. Finally, the flocking is relatively soft and is, therefore, less likely to damage the hair than is the case if the clamp and the cylindrical surface are made from hard material such as metal or plastic.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A hair curling iron comprising:

a heat conductive cylinder having an exterior surface and a hollow center, the exterior surface being flocked;

a handle joined to said cylinder;

a heating element disposed within said hollow center of said cylinder;

electrical means capable of electrically activating said heating element when coupled to a source of electrical power; and a clamping means having a partial cylindrical section having inner and outer surfaces with said inner surface being positioned to be urged against said flocked outer surface of said cylinder, said outer surface of said clamp being flocked.

2. A hair curling iron in accordance with claim 1, wherein said inner surface of said clamp is spring biased against said flocked outer surface of said cylinder.

3. A hair curling iron in accordance with claim 2, wherein said inner surface of said clamp is centered so as to partially wrap around and mate with said outer surface of said cylinder.

4. A hair curling iron in accordance with claim 3, wherein said heat conductive cylinder is plastic.

5. A hair curling iron in accordance with claim 3, wherein said heat conductive cylinder is metallic.

6. A hair curling iron in accordance with claim 3, wherein said clamping means further comprises:

a projection joined to said clamp which extends from said partial cylindrical section toward the handle; and a spring having two ends, the ends respectively engaging said handle and said projection, said spring being compressed so that said inner surface of said partial cylindrical section is biased against said outer surface of said cylinder.

7. A hair curling iron in accordance with claim 6, wherein said projection joined to said clamp further has two extensions which are pivotally attached to said cylinder at diametrically oposite points, the pivotal attachment of said extensions permitting said inner surface of said partial cylindrical section to be moved away from engaging said outer surface of said cylinder upon the application of a force to said projection toward said handle of sufficient magnitude to further compress said ends of said spring toward each other.

8. A hair curling iron according to claim 1, wherein said flocked surfaces are roughened prior to application of a flocking material to such surfaces and are flocked with a non-hygroscopic flocking material.

9. A hair curling iron comprising:

a heat conductive cylinder having an exterior surface and a hollow center, the exterior surface being flocked;

a handle joined to said cylinder;

a heating element disposed within said hollow center of said cylinder;

electrical means capable of electrically activating said heating element when coupled to a source of electrical power; and a clamping means having a partial cylindrical section having inner and outer surfaces with said inner surface being positioned to be urged against said flocked outer surface of said cylinder and at least one of said inner surface and outer surface of said clamp being flocked.

10. A hair curling iron in accordance with claim 9, wherein said inner surface of said clamp is spring biased against said flocked outer surface of said cylinder.

11. A hair curling iron in accordance with claim 10, wherein said inner surface of said clamp is centered so as to partially wrap around and mate with said outer surface of said cylinder.

12. A hair curling iron in accordance with claim 11, wherein said heat conductive cylinder is plastic.

13. A hair curling iron in accordance with claim 11, wherein said heat conductive cylinder is metallic.

14. A hair curling iron in accordance with claim 11, where said clamping means further comprises:

A projection joined to said clamp which extends from said partial cylindrical section toward the handle; and a spring having two ends, the ends respectively engaging said handle and said projection, said spring being compressed so that said inner surface of said partial cylindrical section is biased against said outer surface of said cylinder.

15. A hair curling iron in accordance with claim 14 wherein said projection joined to said clamp further has two extensions which are pivotally attached to said cylinder at diametrically opposite points, the pivotal attachment of said extensions permitting said inner surface of said partial cylindrical section to be moved away from engaging said outer surface of said cylinder upon the application of a force to said projection toward said handle of sufficient magnitude to further compress said ends of said spring toward each other.

16. A hair curling iron according to claim 9, wherein said flocked surfaces are roughened prior to application of a flocking material to such surface and are flocked with a nonhygroscopic flocking material.

17. A heat generating hair curling implement comprising a heat conductive cylinder having an exterior surface and having a cavity formed therein, at least a portion of the exterior surface being flocked;

a handle joined to said cylinder;

A heating element disposed within said cavity of said cylinder; and electrical means for electrically activating said heating element when coupled to a source of electrical power.

18. A heat generating hair curling implement as in claim 17 further comprising a clamping means for holding hair against said cylinder.

19. A heat generating hair curling implement as in claim 18 wherein said clamping means includes a partial cylindrical section having inner and outer surfaces with said inner surface being positioned to be urged against said flocked outer surface of said cylinder and at least one of said inner surface and said outer surface of said clamp being flocked.

20. A heat generating hair curling implement as in claim 19, wherein said inner surface of said clamp is spring biased against said flocked outer surface of said cylinder.

21. A heat generating hair curling implement as in claim 20, wherein said inner surface of said clamp is centered so as to partially wrap around and mate with said outer surface of said cylinder.

22. A heat generating hair curling implement as in claim 21, wherein said heat conductive cylinder is plastic.

23. A heat generating hair curling implement as in claim 22, wherein said heat conductive cylinder is metallic.

24. A heat generating hair curling implement as in claim 23, wherein said clamping means further comprises:

a projection joined to said clamp which extends from said partial cylindrical section toward the handle; and a spring having two ends, the ends respectively engaging said handle and said projection, said spring being compressed so that said inner surface of said partial cylindrical section is biased against said outer surface of said cylinder.

25. A heat generating hair curling implement as in claim 24, wherein said projection joined to said clamp further has two extensions which are pivotally attached to said cylinder at diametrically opposite points, the pivotal attachment of said extensions permitting said inner surface of said partial cylindrical section to be moved away from engaging said outer surface of said cylinder upon the application of a force to said projection toward said handle of sufficient magnitude to further compress said ends of said spring toward each other.

26. A heat generating hair curling implement as in claim 25, wherein said flocked surfaces are roughened prior to application of a flocking material to such surfaces and are flocked with a non-hygroscopic flocking material.

* * * * *